US007861944B2

(12) United States Patent
Yen et al.

(10) Patent No.: US 7,861,944 B2
(45) Date of Patent: Jan. 4, 2011

(54) JETS DEVICE

(75) Inventors: Ruey-Hor Yen, Taipei (TW); Chi-Feng Lin, Taipei (TW); An-Bang Wang, Taipei (TW); Shu-Shen Hsu, Taipei (TW); I-Chun Lin, Taipei (TW)

(73) Assignee: National Taiwan University, Taipei (TW)

( * ) Notice: Subject to any disclaimer, the term of this patent is extended or adjusted under 35 U.S.C. 154(b) by 81 days.

(21) Appl. No.: 11/967,651

(22) Filed: Dec. 31, 2007

(65) Prior Publication Data

US 2009/0001194 A1 Jan. 1, 2009

(30) Foreign Application Priority Data

Jun. 29, 2007 (TW) ..... 96123917 A

(51) Int. Cl.

| | |
|---|---|
| ***B05B 1/08*** | (2006.01) |
| ***B05B 3/04*** | (2006.01) |
| *B05B 3/02* | (2006.01) |
| *F23D 11/04* | (2006.01) |

(52) U.S. Cl. ..... 239/102.2; 239/102.1; 239/214.17; 347/45; 427/490

(58) Field of Classification Search ..... 239/102.1, 239/102.2; 347/45; 427/490
See application file for complete search history.

(56) References Cited

U.S. PATENT DOCUMENTS

| | | | | |
|---|---|---|---|---|
| 5,387,440 | A * | 2/1995 | Takemoto et al. | 427/443.1 |
| 6,126,269 | A * | 10/2000 | Takemoto et al. | 347/45 |
| 6,405,934 | B1 * | 6/2002 | Hess et al. | 239/4 |
| 6,595,623 | B2 * | 7/2003 | Kotera et al. | 347/45 |
| 6,827,634 | B2 * | 12/2004 | Akedo | 451/54 |
| 2006/0243820 | A1 * | 11/2006 | Ng | 239/102.1 |
| 2008/0111003 | A1 * | 5/2008 | Yu et al. | 239/102.2 |

* cited by examiner

*Primary Examiner*—Len Tran
*Assistant Examiner*—James S Hogan
(74) *Attorney, Agent, or Firm*—Volpe and Koenig, P.C.

(57) ABSTRACT

A jet device is provided in the present invention. The jet device includes a chamber having a nozzle and a lateral channel, wherein the lateral channel is disposed along the outer side of a first side of the chamber, the nozzle is disposed at one end of the lateral channel and the chamber is connected with the lateral channel via the nozzle which is connected with the external space, wherein the fluid is filled in the chamber, the nozzle and the later channel and an arc and a block are disposed at the connection of the nozzle and the lateral channel; and a piston disposed at a second side of the chamber.

17 Claims, 3 Drawing Sheets

JETS DEVICE

FIELD OF THE INVENTION

The present invention relates to a jet device, in particular, to a jet device providing a non-zero-net-mass-flux jet.

BACKGROUND OF THE INVENTION

In the prior art, the synthetic jet device includes a central chamber where a central nozzle is disposed on the upper side thereof and a driving device is disposed at the bottom side thereof used for driving one side of the chamber to have a reciprocating motion in order to vary the volume of the chamber so that the volume of the chamber would be shrunken and expended over and over again like a piston, whereby the fluid filled inside the chamber could be pumped out of the chamber to an outer space or be injected from the outer space to the chamber. In the forward stroke the fluid in the chamber will flow through the central nozzle to form a high velocity jet flow, and in the backward stroke the fluid around the central nozzle will be injected into the chamber. Through such reciprocating motion with the forward and backward strokes, a jet flow flowing toward a specific direction is therefore formed. The aforementioned conventional device is characterized in that: the mass flux passing through the cross-section of the central nozzle is zero, that is, the flux is a zero-net-mass-flux. Currently, the applied field of the synthetic jet device are mainly focused on the following three aspects: (1) the flow field control; (2) the mixture and the combustion of the condensed fuel; and (3) heat diffusion system.

Typically, the research regarding how to apply the synthetic jet into the technical field of the flow field control has been widely studied. Earlier to B.C. 1950, there were scholars who had carried out the relevant research, for instance, Perkins and Hazen (1953) who proceeded a study with respect to actively adjust the pressure distribution on the surface of an aerodynamic apparatus in order to improve the aerodynamic performance thereof. In recent years, Rathnasingham (1997) etc. and Rediniotis (1999) etc. also proceed the relevant research to the aforementioned field. Besides, in B.C. 2000, Honohan etc. proceed an experiment to further observe the flow field pattern that an uniform flow passes through a cylinder from the surface of which a synthetic jet is provided. In this research, it is proved that a synthetic jet could efficiently suppress the incensement of the boundary layer along the object surface, which cause the flow field able to resist a more adverse pressure gradient, so as to postpone the generation of the separation flow. Further, such as: Kral etc. (1997), Smith etc. (1998) and Amitay etc. (1999, 2001) utilize the synthetic jet flow to control the lift force and resistance of an aerofoil. Lorkowski etc. (1997) utilize the synthetic jet flow to reduce the surface friction force inside the flat boundary layer. Amitay etc. (2001) utilize this mechanism to control the separation phenomenon for the pipe flow.

The research that apply the synthetic jet flow into the mixture and the combustion of the condensed fuel are mainly focused on how to well blend the fuel and the oxidant by using the synthetic jet flow, in order to provide a combustion status that a fuel-rich and a fuel-lean are alternatively formed. This is the very famous and potential low NOx combustion technique.

In recent years, applying the synthetic jet flow into the cooling system is a newly raising research field. Its application is mainly focused on the packaging process for micro-electro-mechanical-system to improve the efficiency of the heat management. For instance, Glezer and Mahalingam (2002, 2004) integrally utilize the synthetic jet flow to guide the working fluid containing the wasting heat to the cooling fan. The relevant experiment proves that although the mass of the driven fluid in this method is 70% lesser than that of the conventional method, the cooling efficiency is improved approximate up to two or three multiple times. It reveals that the synthetic jet flow possesses the great potential to be applied into this field. Besides, Smith and Beratlis (2003) publish a studying result regarding a series of efforts trying to find out an optimized application of the synthetic jet flow while using in a cooling system. Their research aims to utilize an numerical model to design a best cooling performance by controlling the phase angle, the distance between the nozzle and the heat source and the size of the nozzle etc for the synthetic jet flow applied in a VCSEL (Vertical Cavity Surface Emitting Laser) array. The optimized result demonstrates that a cooling efficiency could be up to 132.2 W/m for the VCSEL array. The research also found that under a certain given vibrated amplitude for the piston apparatus, the heat transfer effect is in a nearly positive correlation with the vibrated frequency. Furthermore, Kercher and Glezer etc. (2003) designed a micro jet cooling element whose vibration of the thin film is driven by utilizing the magnetic force so as to produce a synthetic jet flow to achieve the cooling effect. In the this study, it also compares the result of his research with the conventional cooling fan and compared result reveals that the synthetic jet cooling device performs better than that of the conventional cooling fan.

To sum up, since almost the various synthetic jet flow device provide merely the zero-net-mass-flux flow, the defects such as insufficient discharge, low replacement rate, and bad cooling performance commonly exist in these conventional schemes. Hence, the performance of these conventional schemes did have to be well improved.

To overcome the mentioned drawbacks of the prior art, a jet device is provided.

SUMMARY OF THE INVENTION

According to the first aspect of the present invention, a jet device is provided. The jet device includes a chamber having a nozzle and a lateral channel, wherein the lateral channel is disposed along the outer side of a first side of the chamber, the nozzle is disposed at one end of the lateral channel and the chamber is connected with the lateral channel via the nozzle which is connected with the external space, wherein the fluid is filled in the chamber, the nozzle and the later channel and an arc and a block are disposed at the connection of the nozzle and the lateral channel; and a piston disposed at a second side of the chamber.

Preferably, the jet device according to the present invention further includes an activating device connected with the piston, activating the piston with a reciprocating motion.

Preferably, the shape of the chamber is an axial symmetrical cylinder.

Preferably, the lateral channel is an axial symmetrical circular channel.

Preferably, the nozzle and the lateral channel are the same disposed at the first side of the chamber wherein the nozzle is disposed on the symmetrical axis of the chamber.

Preferably, the arc is used for guiding the flow of the fluid and the block is used for preventing the fluid flowing into the later channel.

Preferably, the piston is a film.

Preferably, the film is one of a piezoelectric-film and a sonic-electric-film.

Preferably, the fluid flows out from the chamber to the external space via the nozzle.

Preferably, the jet device according to the present invention is used for providing a non-zero-net-mass-flux jet.

According to the second aspect of the present invention, a jet device is provided. The A jet device includes a chamber having a nozzle and a lateral channel, wherein the lateral channel is disposed along the outer side of a first side of the chamber, the nozzle is disposed at one end of the lateral channel and the chamber is connected with the lateral channel via the nozzle which is connected with the external space, wherein the fluid is filled in the chamber, the nozzle and the later channel; and a piston disposed at a second side of the chamber.

Preferably, the jet device according to the present invention further includes an activating device connected with the piston activating the piston with a reciprocating motion.

Preferably, the shape of the chamber is axial symmetrical cylinder.

Preferably, the lateral channel is an axial symmetrical circular channel.

Preferably, the nozzle and the lateral channel are the same disposed at the first side of the chamber wherein the nozzle is disposed on the symmetrical axis of the chamber.

Preferably, the arc is disposed at the connection of the nozzle and the lateral channel guiding the flow of the fluid.

Preferably, the piston is a film.

Preferably, the film is one of a piezoelectric-film and a sonic-electric-film.

Preferably, the jet device according to the present invention is used for providing a non-zero-net-mass-flux jet.

The foregoing and other features and advantages of the present invention will be more clearly understood through the following descriptions with reference to the drawings:

BRIEF DESCRIPTION OF THE DRAWINGS

FIG. 2(*b*) is a diagram illustrating the implementation of the injecting stroke of the jet device according to the present invention;

FIG. 3(*b*) is a diagram illustrating the implementation of the injecting stroke for the jet device being regarded as a heat radiator according to the present invention.

DETAILED DESCRIPTION OF THE PREFERRED EMBODIMENT

The present invention will now be described more specifically with reference to the following embodiments. It is to be noted that the following descriptions of preferred embodiments of this invention are presented herein for the aspect of illustration and description only; it is not intended to be exhaustive or to be limited to the precise from disclosed.

Figure 1:
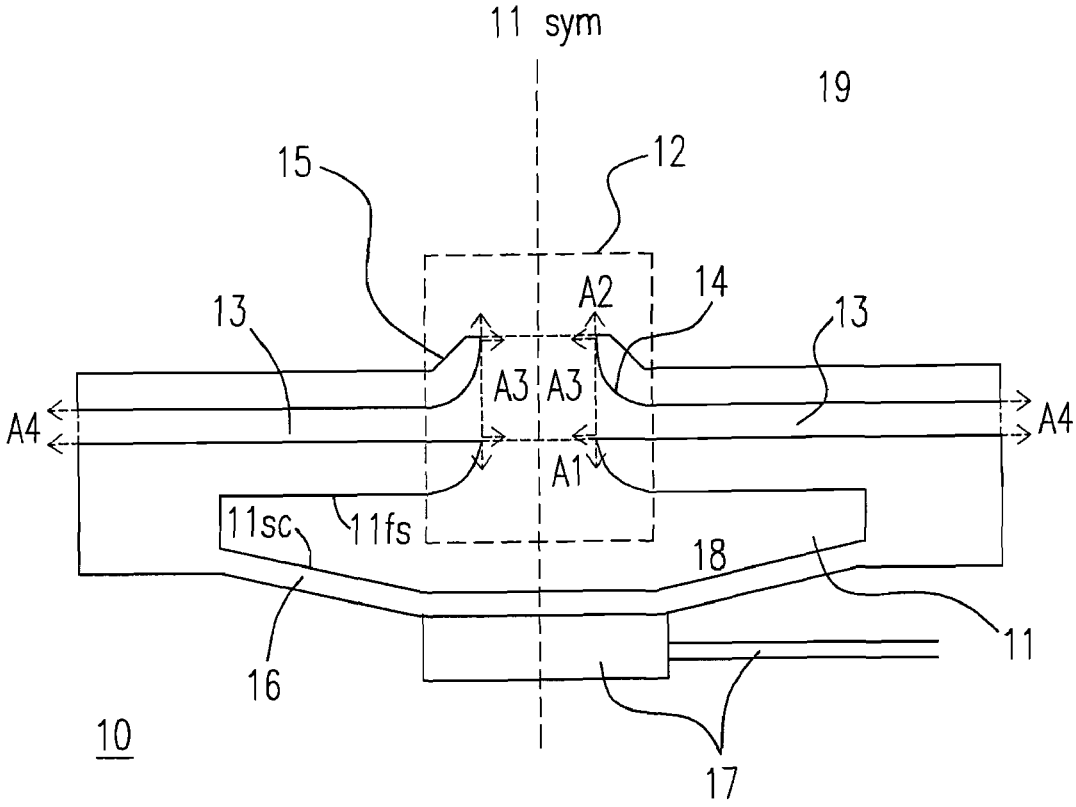
FIG. 1 is a diagram illustrating the architecture of the jet device according to the present invention.

Please refer to FIG. 1, which is a diagram illustrating the architecture of the jet device according to the present invention. The jet device 10 in FIG. 1 includes a chamber 11, a first side 11*fs*, a second side 11*sc*, a symmetrical axis 11*sym*, a nozzle 12 (where the broken line denotes), a lateral channel 13, an arc 14, a block 15, a piston 16, an activating device 17, a fluid 18, an external space 19, a control section A1, a control second A2, a control section A3 and a control section A4, wherein the shape of the chamber 11 is axial symmetrical cylinder and the chamber 11 has a symmetrical axis 11*sym*; the lateral channel 13 is an axial symmetrical circular channel disposed along the outer side of the first side 11*fs* of the chamber 11; the nozzle 12 and the lateral channel 13 are the same disposed at the first side 11*fs* of the chamber 11; the nozzle 12 is disposed on one end of the lateral channel 13 and located on the symmetrical axis 11*sym* of the chamber 11 whereby the chamber 11 could be connected with the lateral channel 13 via the nozzle 12; the nozzle 12 is further connected with the external space 19; the fluid 18 is filled in the chamber 11, the nozzle 12 and the lateral channel 13 and could be a gas or a liquid; the arc 14 is disposed at the connection of the nozzle 12 and the lateral channel 13 for guiding the flow of the fluid; the piston 16 is disposed at the second side 11*sc* of the chamber 11 and is connected with the activating device 17. The piston 16 is activated with a reciprocating motion by a reciprocating motion generated by the activating device 17. Furthermore, a film is taken as an example for the piston 16 according to this embodiment and the film could be a piezoelectric-film or a sonic-electric-film (nevertheless, the implementation of the piston 16 shall not be limited to the film; the conventional piston structure or the device owning the capability of generating a reciprocating motion could also be implemented into the present embodiment as a piston 16). The control section A1 is located at the connection of the chamber 11 and the nozzle 12, the control section A2 is located at the connection of the nozzle 12 and the external space 19, the control section A3 is located at the connection of the lateral channel 13 and the nozzle 12, and the control section A4 being a circumferential directional cross-section is located at a specific position at the lateral channel 13.

The acting mode and the working principle thereof of the jet device according to the present invention are demonstrated as follows. First of all, a jetting stroke is defined as the movement when the piston 16 is moving toward the nozzle 12, and in contrast, an injecting stroke is defined as the movement when the piston 16 is moving backward to the nozzle 12. The jetting and the injecting strokes are driven by the activating device 17 moving in a reciprocating motion so that the jetting and the injecting strokes of the piston 16 would thus be generated thereby. At the initial stage that is a static status with none of actions of the jet device 10, the fluid 18 rests in the chamber 11, the nozzle 12, the lateral channel 13 and the external space 19.

Figure 2A:
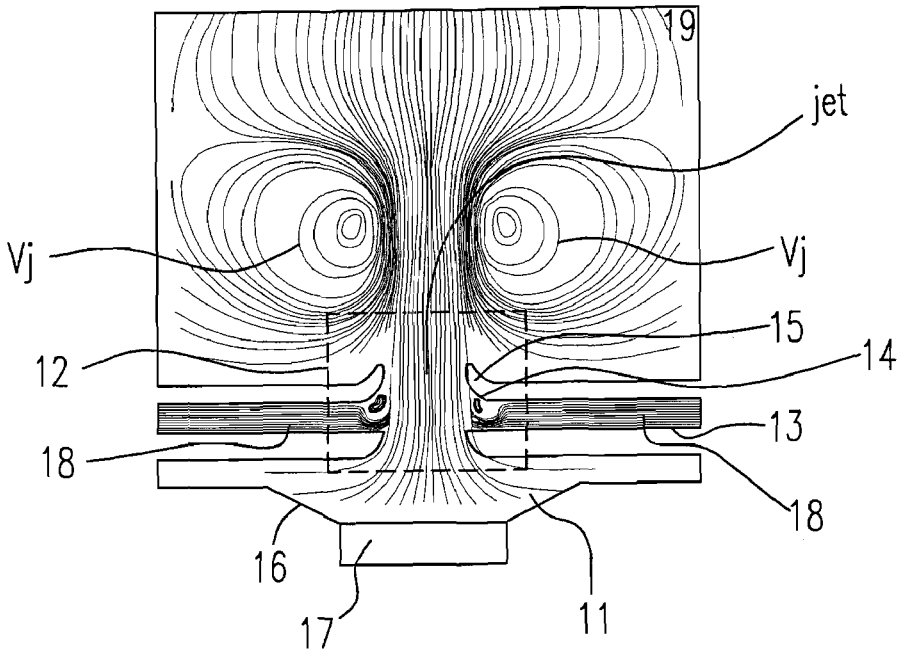
FIG. 2(*a*) is a diagram illustrating the implementation of the jetting stroke of the jet device according to the present invention.
Figure 2B:
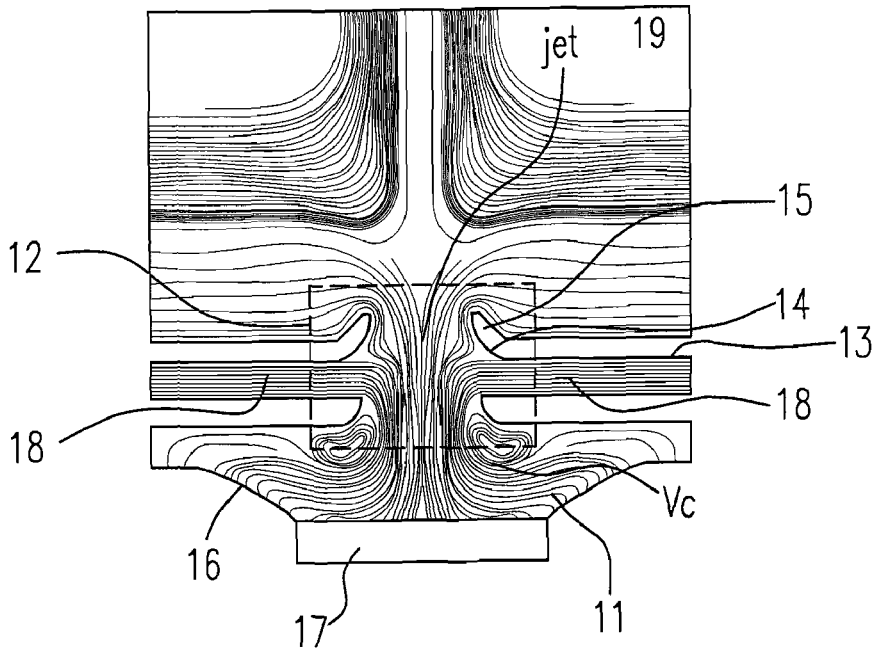

Please refer to FIG. 2(*a*), which is a diagram illustrating the implementation of the jetting stroke of the jet device according to the present invention. While performing the jetting stroke, since the piston 16 is moving toward the nozzle 12, the fluid 18 originally filled in the chamber 11 would be jetted/transported out of from the chamber 11 to the external space 19 via the control sections A1 and A2 due to the volumetric shrinkage of the chamber 11 caused by the squeeze coming from the piston 16. During the jetting process, a majority of the fluid 18 would be pumped out of from the chamber 11, and at this instance, a jetting vortex Vj is thus formed around the control section A2 and a compounded jet JET is consequently formed by the confluence of the jetting vortex Vj and the pumped fluid. The fluid 18 passing through the control section A3 will drive the fluid 18 inside the lateral channel 13 so that a recurrent vortex cell would thus be formed around the exit part of the lateral channel 13 rightly connected to the nozzle 12, and thus a minority of the fluid 18 passing through the control section A3 will be injected into the recurrent vortex cell rather than jetted out to the external space 19. Hence, the arc 14 is rightly configured at the exit part of the lateral channel 13 connected to the nozzle 12 in order to provide the guidance to lead the fluid 18 flowing out of from the chamber 11 to the external space 19. Based upon the identical reason, and the block 15 plays a similar role that will block/prevent the fluid 18 from being back-injected into the lateral channel 13.

Please refer to FIG. 2(*b*), which is a diagram illustrating the implementation of the injecting stroke of the jet device according to the present invention. While performing the injecting stroke, since the piston 16 is moving backward to the nozzle 12, the fluid 18 originally filled in the lateral channel 13 will be injected into the chamber 11 via the control sections A3 due to the volumetric expansion of the chamber 11. At this moment, the jetted fluid 18 out of from the chamber 11 to the external space 19 still owns an upward velocity due to the inertia, so it is apparently not easy to be injected into the chamber 11. It shall be noted that the fluid 18 filled in the lateral channel 13 could be provided by other independent fluid sources completely unassociated with the fluid 18 already filled in the chamber 11. Therefore, the integration of flow mass with respect to time for the fluid passing through the control section A3 would not be zero. That is, the net mass flux passing through the control section A3 is not zero. In this respect, the jet device disclosed by the present invention could be used for providing a non-zero-net-mass-flux jet.

Figure 3A:
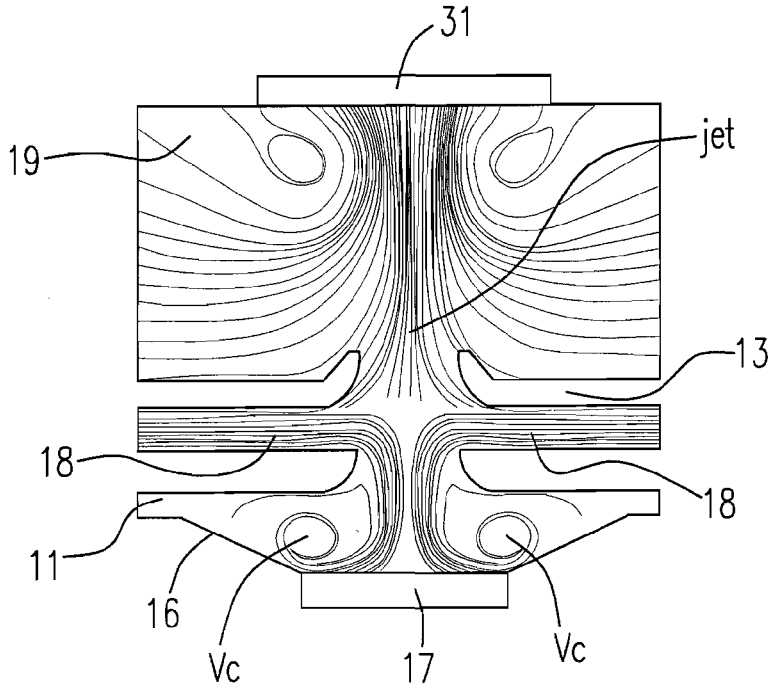
FIG. 3(*a*) is a diagram illustrating the implementation of the jetting stroke for the jet device being regarded as a heat radiator.
Figure 3B:
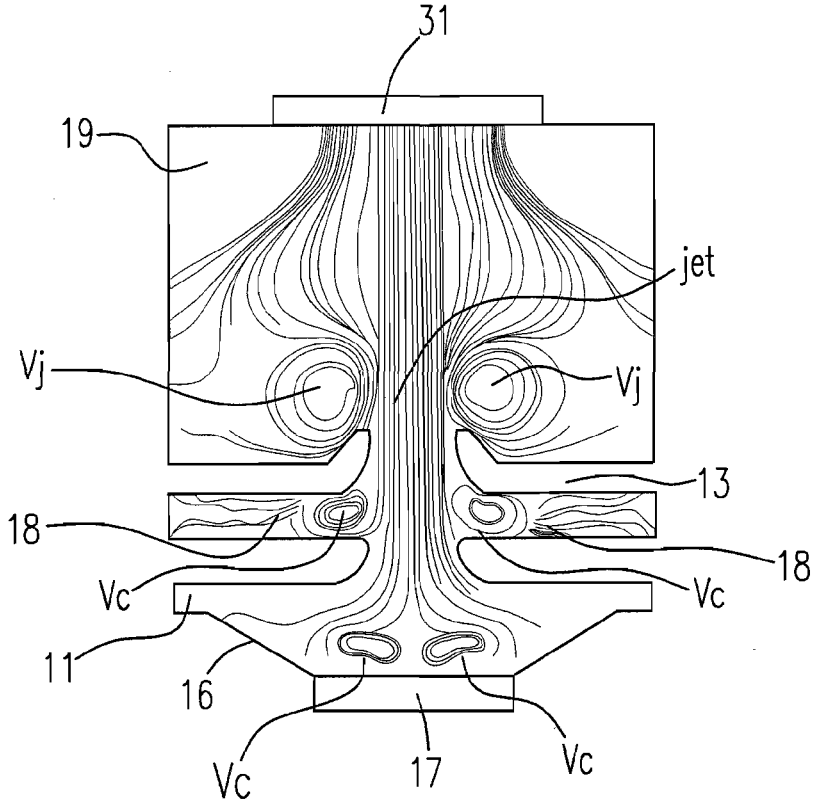

The jet device according to the present invention could be also regarded as a heat radiator for cooling heat sources such as a LCD (Liquid Crystal Display) back light module or a CPU (Central Processing Unit). The cooling principle for the present invention will be introduced as follows. Please refer to FIGS. 3(*a*) and (*b*) which are diagrams respectively illustrating the implementation of the jetting stroke for the jet device being regarded as a heat radiator and illustrating the implementation of the injecting stroke for the jet device being regarded as a heat radiator according to the present invention. A heat source 31 and a second fluid 32 are further included in the FIGS. 3(*a*) and (*b*), wherein the heat source 31 could be a back light module, CPU, logical IC, the chip set having higher temperature than that of the surrounding needed to be cooled down or other objects needed to be cooled down. The temperature of the second fluid 32 is lower than that of the heat source 31.

While the jet device disclosed by the present invention is used for cooling the heat source 31, since the fluid 18 filled in the lateral channel 13 could be provided by other independent fluid sources unassociated with the fluid 18 already filled in the chamber 11, one could fill a second fluid 32 whose temperature is lower than that of the heat source 31 into the lateral channel 13, and then the second fluid 32 will be pumped out of from the chamber 11 by a reciprocating motion to the external space 19 to contact with the heat source 31, whereby a heat convection will therefore be generated between the second fluid 32 and the heat source 31, so that an effect to diffuse the heat containing in the heat source 31 is achieved.

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims that are to be accorded with the broadest interpretation, so as to encompass all such modifications and similar structures. According, the invention is not limited by the disclosure, but instead its scope is to be determined entirely by reference to the following claims.

What is claimed is:

1. A non-zero-net-mass-flux jet device for providing a non-zero-net-mass-flux jet and transporting a first fluid to an external space, comprising:

a chamber, having a nozzle and a lateral channel, wherein the lateral channel is disposed along the outer side of a first side of the chamber, the nozzle is disposed at one end of the lateral channel and the chamber is connected with the lateral channel via the nozzle, the nozzle being connected with an external space, wherein the first fluid is supplied from a source independent of a second fluid in the external space to the lateral channel flows between the source and the chamber through the lateral channel and is filled in the chamber, the nozzle and the lateral channel and an arc and a block are disposed at the connection of the nozzle and the lateral channel; and a piston disposed at a second side of the chamber, activated with a reciprocating motion generated by an activating device and jetting, via the reciprocating motion, the first fluid out of the chamber through the nozzle.

2. The device according to claim 1, wherein the activating device is connected with the piston for activating the piston with the reciprocating motion.

3. The device according to claim 1, wherein the shape of the chamber is an axial symmetrical cylinder.

4. The device according to claim 1, wherein the lateral channel is an axial symmetrical circular channel.

5. The device according to claim 1, wherein the nozzle and the lateral channel are the same disposed at the first side of the chamber wherein the nozzle is disposed on the symmetrical axis of the chamber.

6. The device according to claim 1, wherein the arc is used for guiding the flow of the fluid and the block is used for preventing the fluid flowing into the lateral channel.

7. The device according to claim 1, wherein the piston is a film.

8. The device according to claim 7, wherein the film is one of a piezoelectric-film and a sonic-electric-film.

9. The device according to claim 1, wherein the fluid flows out from the chamber to the external space via the nozzle.

10. A non-zero-net-mass-flux jet device for providing a non-zero-net-mass-flux jet and transporting a first fluid to an external space for cooling a heat source in the external space, comprising:

a chamber, having a nozzle and a lateral channel, wherein the lateral channel is disposed along the outer side of a first side of the chamber, the nozzle is disposed at one end of the lateral channel and the chamber is connected with the lateral channel via the nozzle, the nozzle being connected with the external space, wherein the first fluid is supplied from a source independent of a second fluid in the external space to the lateral channel, flows between the source and the chamber through the lateral channel and is filled in the chamber, the nozzle and the lateral channel; and a piston disposed at a second side of the chamber, activated with a reciprocating motion generated by an activating device and jetting, via the reciprocating motion, the first fluid out of the chamber through the nozzle, the temperature of the first fluid being lower than that of the heat source.

11. The device according to claim 10, wherein the activating device is connected with the piston for activating the piston with the reciprocating motion.

12. The device according to claim 10, wherein the shape of the chamber is an axial symmetrical cylinder.

13. The device according to claim 10, wherein the lateral channel is an axial symmetrical circular channel.

14. The device according to claim 10, wherein the nozzle and the lateral channel are the same disposed at the first side of the chamber wherein the nozzle is disposed on the symmetrical axis of the chamber.

15. The device according to claim 10, wherein an arc is disposed at the connection of the nozzle and the lateral channel guiding the flow of the fluid.

16. The device according to claim 10, wherein the piston is a film.

17. The device according to claim 16, wherein the film is one of a piezoelectric-film and a sonic-electric-film.

* * * * *